US007971270B2

(12) United States Patent
Cox et al.

(10) Patent No.: US 7,971,270 B2
(45) Date of Patent: Jul. 5, 2011

(54) PROTECTIVE GARMENT FOR NUCLEAR ENVIRONMENTS

(75) Inventors: Gary L. Cox, Heath, TX (US); Brian W. Lyons, Heath, TX (US)

(73) Assignee: International Enviroguard Systems, Inc., Mesquite, TX (US)

( * ) Notice: Subject to any disclaimer, the term of this patent is extended or adjusted under 35 U.S.C. 154(b) by 671 days.

(21) Appl. No.: 12/053,868

(22) Filed: Mar. 24, 2008

(65) Prior Publication Data

US 2009/0235439 A1 Sep. 24, 2009

(51) Int. Cl.
*A41D 13/00* (2006.01)

(52) U.S. Cl. ..... 2/69

(58) Field of Classification Search ..... 2/81, 82, 2/456, 457–458, 97, 79, 2.17, 78.3, 167, 2/69, 69.5, 93, 94, 84, 202, 901
See application file for complete search history.

(56) References Cited

U.S. PATENT DOCUMENTS 4,023,223 A * 5/1977 Anderson et al. ..... 441/104
4,864,654 A * 9/1989 Schriver et al. ..... 2/84
4,901,370 A * 2/1990 Suda ..... 2/457
4,932,078 A * 6/1990 Jones et al. ..... 2/70
4,943,475 A * 7/1990 Baker et al. ..... 442/71
5,279,287 A * 1/1994 Wiseman, Sr. ..... 128/201.29
5,560,043 A * 10/1996 Armstrong ..... 2/69.5
5,626,947 A * 5/1997 Hauer et al. ..... 428/195.1
5,717,999 A * 2/1998 Lurry ..... 2/69
6,047,413 A * 4/2000 Welchel et al. ..... 2/457
6,286,144 B1 * 9/2001 Henderson et al. ..... 2/69
6,460,198 B1 * 10/2002 Dilworth et al. ..... 2/457
6,745,400 B1 * 6/2004 Paciorkowski ..... 2/69
6,748,609 B1 * 6/2004 Garigan ..... 2/457
6,792,625 B2 * 9/2004 Hexels ..... 2/457
7,203,974 B2 * 4/2007 Jones et al. ..... 2/456
7,805,769 B2 * 10/2010 Hunt ..... 2/69

* cited by examiner

*Primary Examiner* — Tejash Patel
(74) *Attorney, Agent, or Firm* — The Marbury Law Group, PLLC

(57) ABSTRACT

A protective garment for nuclear environments is formed of a tri-laminate 30/30/30 water resistant barrier fabric. The garment can be incinerated so as to provide a disposable, one time use coverall particularly adapted for use in nuclear/radioactive environments. The coverall provides integrated elements for water resistant (i.e., splashproof), breathable, comfortable contamination protection. It is adapted for use with various types of breathing apparatuses, included external air lines, back-mounted self-contained breathing apparatuses (SCBA), and emergency breathing bottles or apparatuses. Air tanks and bottles are covered by the garment and thus do not need to be decontaminated. The garment also includes elements for use with air sampling devices and/or dosimetry equipment that are often worn by such workers.

20 Claims, 3 Drawing Sheets

PROTECTIVE GARMENT FOR NUCLEAR ENVIRONMENTS

BACKGROUND

The present invention relates to disposable protective clothing for use in nuclear/radioactive environments.

Prior art protective clothing is disclosed in U.S. Pat. Nos. 4,901,370, 4,943,475, 5,626,947, 6,460,198, 6,792,625, and 7,203,974.

U.S. Pat. No. 4,901,370 discloses a garment for protection against environmental contamination. The garment is formed of a laminate and includes a built-in hood with a transparent window and filtered openings for ingress of breathing air. A mouthpiece and conduit with a check valve are used for exhalation so as to avoid the use of an external air supply.

U.S. Pat. No. 4,943,475 discloses a multilayer composite protective fabric material and its use in protective clothing. The composite fabric material includes a fabric support layer and a composite permselective membrane layer that is permeable to water vapor but impermeable to toxic organic vapors.

U.S. Pat. No. 5,626,947 discloses composite chemical barrier films and fabrics that are useful in protective garments. The composite barrier material is made by laminating a barrier film to a flexible substrate using a thermoplastic resin and topcoating the barrier film with a similar or dissimilar thermoplastic resin to allow fabric seaming when the fabric is fabricated into a protective garment.

U.S. Pat. No. 6,460,198 discloses a garment system for healthcare providers which includes pants, a shirt, and a hood that provides a protective barrier against infectious materials in body fluids. The garment is adapted for use in field operating and/or uniformed organizations by the inclusion of details such as pockets and a protective hood.

U.S. Pat. No. 6,792,625 discloses protective suit for protection against harmful chemical and biological substances. The suit includes an outer layer and a liner which is disposed underneath the outer layer and is provided with a barrier layer against chemical and biological substances. The protective suit is configured as a coverall, the barrier layer which has been incorporated into the liner being a membrane which is surrounded on both sides by a protective layer each. The suit includes an integrated hood and socks. The hood uses a central zipper and sewn seams are taped with a three layer barrier.

U.S. Pat. No. 7,203,974 discloses scrubs or similar protective garments that are limited reusable products. The products may be laundered and reused after laundering a number of times. Although the limited reusable products contain water-soluble material, the limited reusable products maintain structural integrity during multiple washing cycles so that the product may be reused between washing cycles. The limited reusable products release contaminants during the washing process. One embodiment discloses a launderable coverall with 11 pockets for dosimetry use.

What would be desirable is a disposable garment for universal application in the nuclear industry for both indoor and outdoor applications that provides integrated elements for breathable, water resistant, comfortable contamination protection for use with external air hoses, a back-mounted self-contained breathing apparatus (SCBA), an emergency breathing apparatus (e.g., SKA-PAK®), air sampling equipment and/or dosimetry equipment.

BRIEF SUMMARY

Embodiments disclosed herein provide a disposable, one time use coverall particularly adapted for use in nuclear/radioactive environments. The coverall is a disposable garment that can be incinerated for disposal. The garment provides integrated elements for water resistant (i.e., splashproof), breathable, comfortable contamination protection for use with various types of breathing apparatuses, included external air lines, back-mounted self-contained breathing apparatuses (SCBA), and emergency breathing bottles or apparatuses (e.g., SKA-PAK®). The garment also includes elements for use with air sampling devices and/or dosimetry equipment that are often worn by such workers.

In an embodiment, the coverall is a made of a tri-laminate 30/30/30 water resistant fabric which can be fabricated in various colors. The tri-laminate 30/30/30 fabric comprises 30 grams per square meter of spunbond polypropylene, 30 grams per square meter of microporous film and 30 grams per square meter of spunbond polypropylene that are laminated together to produce a breathable, water resistant fabric. The coverall includes a zipper front, lock stitch/ultrasonically welded seams, and an expanded back for a self contained breathing apparatus (SCBA). The coverall has an attached draw string hood for covering the head and drawing tight against a breathing mask. To prevent contamination from other openings, the coverall includes attached boots with elastic at the ankle and sleeves with elastic at the wrists.

In another embodiment, and to provide for additional equipment, the coverall includes air line loops attached on top of shoulders, dosimeter tabs on the left and right front chest, approximately 11" down from top of the shoulder, and dosimeter tabs on the left and right front waist, approximately 26" from top of shoulder for the average size garment, with actual placement adjusted for garment size. The coverall further includes an approximately 4" wide slit on the right front of the garment between the shoulder and breast, placed horizontally with a hook and loop closure fastened flap, an emergency bottle (e.g., SKA-PAK®) pouch (approximately 10" tall, 8" wide and 8" deep) on left hip, a sealed opening with a 1" diameter and a 4" long sleeve for airline access on right hip, an approximately 4" opening w with a hook and loop closure fastened flap positioned approximately 1" from the front zipper and placed diagonally approximately 3-4" from top of left shoulder, an approximately 7" wide slit with an attached sewn-in pocket with a hook and loop closure on the right front hip, and two rear hip pockets (approximately 7"×7") with openings at the top that do not include any closure means.

The tri-laminate fabric used in an embodiment eliminates the need for multiple layers and improves comfort by being thin and breathable (i.e., vapor permeable based on the microporous film). The inclusion of multiple features allow a single, universal coverall to be used in multiple applications in facilities such as nuclear plants, in both indoor and outdoor environments, thus simplifying the number of different coveralls that a facility needs to stock. The coverall also simplifies disposal requirements for the facility since all used coveralls can simply be incinerated for disposal.

DETAILED DESCRIPTION

Figure 1:
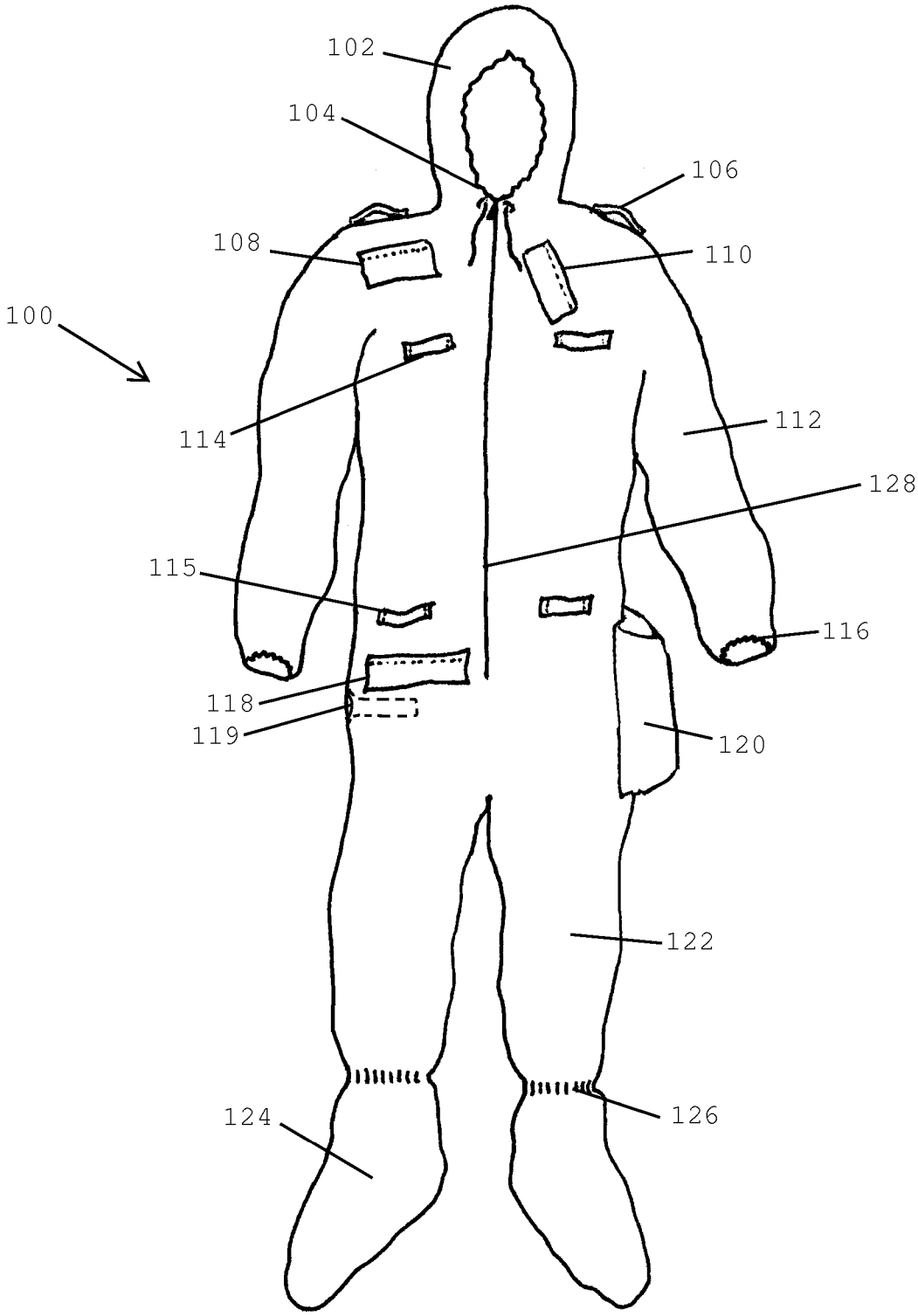
FIG. 1 illustrates a front view of a preferred embodiment of a coverall.

One embodiment of a protective garment (hereinafter a "coverall") for use in nuclear environments, is disclosed in FIG. 1, which illustrates a front view of the coverall 100. The coverall 100 is constructed from a tri-laminate 30/30/30 water resistant fabric which can be fabricated in various colors. Preferred construction techniques include lock stitch/ultrasonically welded seams, although other methods, such as use of serged seams or a two-needle felled stitch with taped seams, are also contemplated. The coverall 100 includes a hood 102, sleeves 112, and legs 122 that are attached to the body portion of the coverall 100 and are accessed by a user through a front opening operated by a zipper 128. The front of hood 102 has a draw string opening 104 for drawing the hood 102 tight against a breathing mask. To prevent contamination from other openings, the legs 122 of the coverall include attached boots 124 with elastic 126 at the ankle, and the sleeves 112 include elastic 116 at the wrists. The elastic 116 and 126 also help keep the coverall 100 in position on the user.

The coverall 100 can be produced in various standard sizes to accommodate variously-sized users. The lightweight tri-laminate fabric that is held in place on a user by elastic 116 and 126 and drawstring 104 allows freedom of movement for the wearer in order for the wearer to complete their assigned task in the hazardous nuclear environment. The breathable nature of the tri-laminate fabric provides improved comfort in comparison to other barriers such as PVC nuclear suits or combinations such as cotton coveralls and PVC outerwear.

To provide for radiation monitoring equipment, the coverall 100 includes air dosimeter tabs 114 on the left and right front chest, approximately 11" (~28 cm) down from top of the shoulder of an average size garment, and dosimeter tabs 115 on the left and right front waist, approximately 26" (~66 cm) from the top of shoulder of the average size garment. The actual placement of the dosimeter tabs 114 and 115 on the front of coverall 100 should be adjusted for garment size, with placements proportionately closer to the shoulder for smaller sized and further away for larger sizes.

In addition to zipper 128, user access to the inside of the garment is provided by openings or slits 108 and 110. Slit 108 is approximately 4" (~10 cm) wide located on the right front of the garment between the shoulder and breast, placed horizontally with a hook and loop closure fastened flap. Slit 110 provides an approximately 4" (~10 cm) opening with a hook and loop closure fastened flap positioned approximately 1" (~2.5 cm) from the front zipper and placed diagonally approximately 3-4" (~7.5-10 cm) from top of left shoulder. Closing the flaps on slits 108 and 110 will allow the garment to be splashed. Slits 108 and/or 110 can be used in a variety of ways by a user, including but not limited to providing sampling access for user-carried air sampling devices.

Coverall 100 includes numerous elements to provide for use with a variety of breathing apparatuses. For use with external air lines or hoses, coverall 100 includes air line loops 106 attached on top of the shoulders to secure an air line to the user. The air line can then be fed into the coverall through sealed opening 119 that is formed as a 1" (~2.5 cm) diameter, 4" (~10 cm) long sleeve designed for air line access. Opening 119 is preferably positioned on the right hip of the coverall 100, but can be located in any suitable location.

The coverall 100 further includes an emergency bottle (e.g., SKA-PAK®) pouch 120 that is approximately 10" (~25 cm) tall, 8" (~20 cm) wide and 8" (~20 cm) deep), preferably on the left hip, as illustrated. In this manner, an emergency bottle with breathing air can be carried by the user in a manner that does not interfere with the user's mobility and does not require decontamination of the bottle for subsequent use.

The front of coverall 100 also preferably includes an approximately 7" (~17.8 cm) wide slit 118 with an attached sewn-in pocket with a hook and loop closure on the right front hip (although other locations are also anticipated). Slit 118 and its associated pocket allow for storage of small items that might be needed by a user (e.g., keys, gauges, rules, etc.), but frees the user's hands and protects the items from contamination if the items are not used. As illustrated in the rear view of coverall 100 in FIG. 2, two rear hip pockets 132 can also be provided for items the user may need to carry and access quickly. The approximately 7"×7" (~17.8 cm×17.8 cm) pockets 132 have openings at the top that do not include any closure means. These pockets 132 can be used in many ways, but preferably are used with disposable items that can be later incinerated, such as paper diagrams/instructions or wipes/shop-rags.

Figure 2:
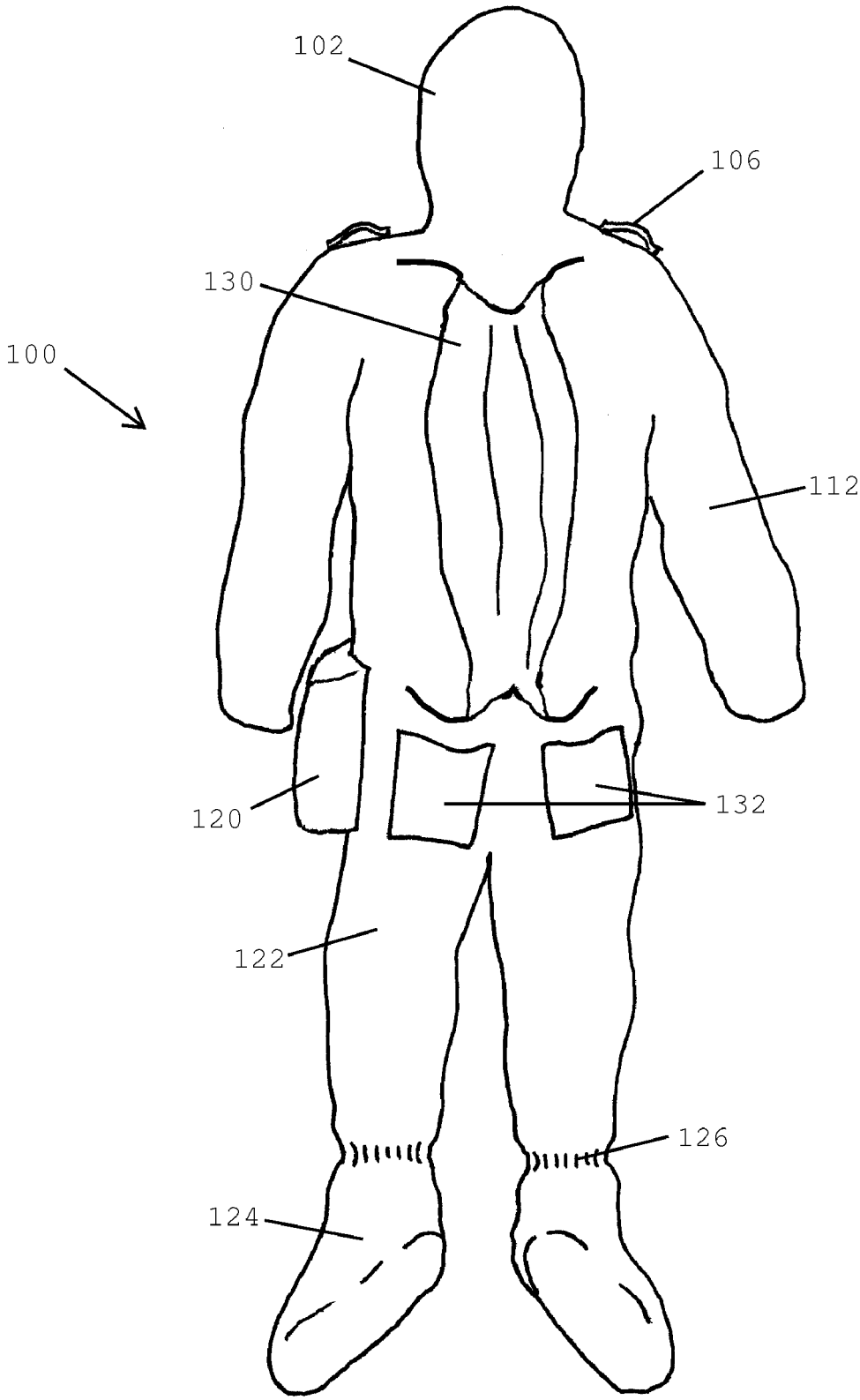
FIG. 2 illustrates a rear view of a preferred embodiment of a coverall.

FIG. 2 also illustrates an expanded back portion 130 of coverall 100 to provide room inside the garment for a self contained breathing apparatus (SCBA) to be worn on the users back. By allowing the SCBA equipment to be worn inside the coverall 100, the need to decontaminate the majority of the SCBA equipment (i.e., everything except for the exposed mask) can be eliminated. While illustrated in a particular configuration, numerous configurations (pleated, rectangular, cylindrical, etc.) for the expanded back portion 130 can be used without departing from the invention.

Figure 3:
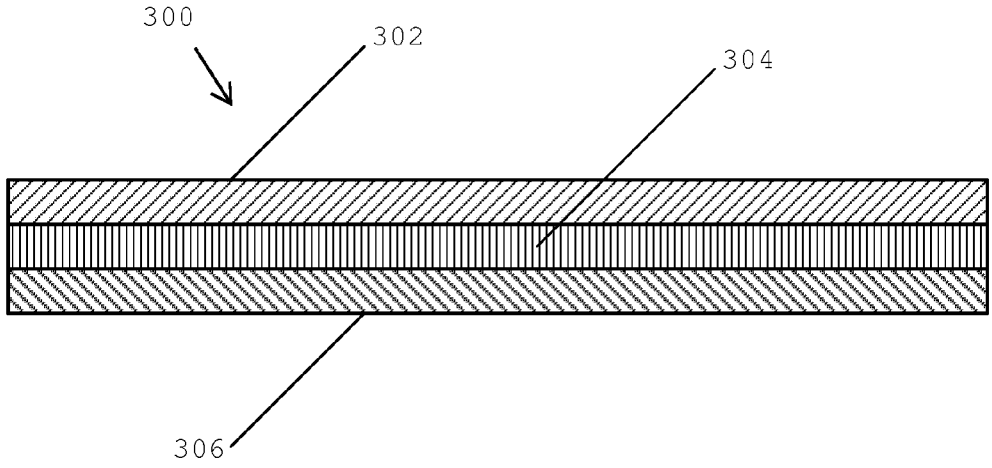
FIG. 3 illustrates a detail of a tri-laminate fabric.

As illustrated in FIG. 3, the tri-laminate 30/30/30 water resistant fabric 300 comprises 30 grams per square meter of spunbond polypropylene 302, grams per square meter of microporous film 304 and 30 grams per square meter of spunbond polypropylene 306 that are laminated together to produce a breathable, water resistant fabric 300. The microporous film 304 has openings sized to allow water vapor to pass through so as to increase wearer comfort, but which are sufficiently small to prevent the passage of liquid such as water.

The outer spunbond polypropylene layer 302 of the tri-laminate fabric 300 of the coverall 100 can be colored, dyed, or printed as required by the end-user. For example, various colors or other printed indicia can be used to indicate sizes so that users can quickly and easily select garments of the proper size. Similarly, workers on different teams or details can have garments of different colors so as to indicate the user's role.

An embodiment of a protective garment can comprise a body garment formed of barrier fabric. This body garment includes a main body, a pair of legs, a pair of arms, and a hood. The main body includes a front zipper opening that extends sufficiently down the front to allow a user to enter and exit the garment. The main body also has a plurality of dosimetry tabs on a front of the main body so that dosimetry badges or dosimeters can be attached thereto. More particularly, the tabs can be a pair of chest dosimetry tabs and a pair or waist dosimetry tabs.

To address various breathing air systems, the main body in this embodiment includes a sealed inlet opening for an air line, which can take the form of a longitudinally-extending tubular section of fabric having a diameter slightly greater than an air line hose diameter, an expanded portion containing a pouch sized for encompassing an emergency air bottle, and expanded section on the back or rear portion that is sized to encompass a user-worn self-contained breathing apparatus (SCBA) tank.

To address protection and fit, the pair of legs have attached boots and elastic at each ankle, the pair of arms have elastic at each wrist, and the hood includes a drawstring opening.

Variations on this embodiment include those wherein the barrier fabric is a breathable laminated fabric, and in particular wherein the breathable laminated fabric consists of an outer layer of spunbond polypropylene having a weight of 30 grams per square meter, a middle layer of microporous film having a weight of 30 grams per square meter, and an inner layer of spunbond polypropylene having a weight of 30 grams per square meter, wherein the outer, middle, and inner layers are laminated together to produce a breathable, water resistant barrier fabric.

Other variations on this embodiment include those having an air line loop on each shoulder of the main body, those with at least one slit opening between a shoulder and a chest dosimetry tab, and a flap with a hook and loop closure for covering the slit opening, which can be horizontal or diagonal.

Additional variations can include pockets, such as a sewn-in pocket including a flap with a hook and loop closure, the pocket being located a in a lower front portion of the main body, or a pair of open-top pockets formed in a lower rear portion of the main body.

Another embodiment of a protective garment can be a body garment formed of barrier fabric comprising a main body, a pair of legs, a pair of arms, and a hood. In this embodiment, the main body includes a front zipper opening sufficient for a user to enter and exit the garment, the pair of legs include attached boots and elastic at each ankle, the pair of arms includes elastic at each wrist, and the hood comprises a drawstring opening. For this embodiment, the barrier fabric consists of an outer layer of spunbond polypropylene having a weight of 30 grams per square meter, a middle layer of microporous film having a weight of 30 grams per square meter, and an inner layer of spunbond polypropylene having a weight of 30 grams per square meter, wherein the outer, middle, and inner layers are laminated together to produce a breathable, water resistant barrier fabric.

A variation of this embodiment includes breathing apparatus details, wherein the main body further includes an air line loop on each shoulder, a sealed inlet opening for an air line, which can be a longitudinally-extending tubular section of fabric having a diameter slightly greater than an air line hose diameter, an expanded portion containing a pouch sized for encompassing an emergency air bottle, and a rear expanded section sized to encompass a user-worn self-contained breathing apparatus (SCBA) tank. This variation can optionally include a pair of chest dosimetry tabs and a pair or waist dosimetry tabs on a front of the main body. It can also include a slit opening between a shoulder and a chest dosimetry tab, and a flap with a hook and loop closure for covering the slit opening, where the slit opening can be horizontal or diagonal.

Another variation of this embodiment includes pocket, which can take the form of a sewn-in pocket including a flap with a hook and loop closure, the pocket being located a in a lower front portion of the main body, or a pair of open-top pockets formed in a lower rear portion of the main body.

A protective garment for nuclear environments has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A protective garment, comprising:

a body garment formed of barrier fabric comprising a main body, a pair of legs, a pair of arms, and a hood, wherein:

the main body has a front surface and a rear surface and wherein the main body comprises:

a zipper opening on the front surface sufficient for a user to enter and exit the garment;

a plurality of dosimetry tabs arranged on the front surface of the main body;

a sealed inlet opening for an air line;

an expanded portion containing a pouch sized for encompassing an emergency air bottle; and an expanded section on the rear surface sized to encompass a user-worn self-contained breathing apparatus (SCBA) tank;

each leg of the pair of legs has a distal portion proximate to an ankle of a user of the protective garment and wherein each leg comprises:

attached boots; and elastic encircling the distal portion;

each arm of the pair of arms has a distal portion proximate to a wrist of a user of the protective garment and comprises elastic encircling the distal portion; and the hood comprises a drawstring opening.

2. The protective garment of claim 1, wherein the barrier fabric is a breathable laminated fabric.

3. The protective garment of claim 2, wherein the breathable laminated fabric consists of:

an outer layer of spunbond polypropylene having a weight of 30 grams per square meter;

a middle layer of microporous film having a weight of 30 grams per square meter; and an inner layer of spunbond polypropylene having a weight of 30 grams per square meter;

wherein the outer, middle, and inner layers are laminated together to produce a breathable, water resistant barrier fabric.

4. The protective garment of claim 1, wherein the plurality of dosimetry tabs comprises a first pair of dosimetry tabs arranged on the front surface proximate to the chest of the user of the protective garment and a second pair of dosimetry tabs arranged on the front surface proximate to the waist of the user of the protective garment.

5. The protective garment of claim 4, wherein the main body further comprises top portions proximate to the shoulders of a user of the protective garment and wherein the protective garment further comprises an air line loop on each top portion.

6. The protective garment of claim 5, further comprising:

at least one slit opening between a shoulder and a chest dosimetry tab, and a flap with a hook and loop closure for covering the slit opening.

7. The protective garment of claim 6, wherein the at least one slit opening is a horizontal slit opening.

8. The protective garment of claim 6, wherein the at least one slit opening is a diagonal slit opening.

9. The protective garment of claim 1, further comprising a sewn-in pocket including a flap with a hook and loop closure, the pocket being located in a lower portion of the front surface.

10. The protective garment of claim 1, further comprising a pair of open-top pockets formed in a lower portion of the rear surface.

11. The protective garment of claim 1, wherein the sealed inlet opening for an air line comprises a longitudinally-extending tubular section of fabric having a diameter slightly greater than an air line hose diameter.

12. A protective garment, comprising:

a body garment formed of barrier fabric comprising a main body, a pair of legs, a pair of arms, and a hood, wherein:

the main body has a front surface and comprises:

a zipper opening on the front surface sufficient for a user to enter and exit the garment;

each leg of the pair of legs has a distal portion proximate to an anlde of a user of the protective garment and wherein each leg comprises:

attached boots; and elastic encircling the distal portion;

each arm of the pair of arms has a distal portion proximate to a wrist of a user of the protective garment and comprises elastic encircling the distal portion; and the hood comprises a drawstring opening, and wherein the barrier fabric consists of:

an outer layer of spunbond polypropylene having a weight of 30 grams per square meter;

a middle layer of microporous film having a weight of 30 grams per square meter; and an inner layer of spunbond polypropylene having a weight of 30 grams per square meter;

wherein the outer, middle, and inner layers are laminated together to produce a breathable, water resistant barrier fabric.

13. The protective garment of claim 12, wherein the main body further comprises:

a rear surface;

top portions proximate to the shoulders of a user of the protective garment;

an air line loop on each top portion;

a sealed inlet opening for an air line;

an expanded portion containing a pouch sized for encompassing an emergency air bottle; and an expanded section on the rear surface sized to encompass a user-worn self-contained breathing apparatus (SCBA) tank.

14. The protective garment of claim 13, further comprising a first pair of dosimetry tabs arranged on the front surface proximate to the chest of the user and a second pair of dosimetry tabs arranged on the front surface proximate to the waist of the user.

15. The protective garment of claim 14, further comprising:

at least one slit opening between a shoulder and one of the pair of chest dosimetry tabs, and a flap with a hook and loop closure for covering the slit opening.

16. The protective garment of claim 15, wherein the at least one slit opening is a horizontal slit opening.

17. The protective garment of claim 15, wherein the at least one slit opening is a diagonal slit opening.

18. The protective garment of claim 12, further comprising a sewn-in pocket including a flap with a hook and loop closure, the pocket being located a in a lower portion of the front surface of the main body.

19. The protective garment of claim 12, further comprising a rear surface and a pair of open-top pockets formed in a lower portion of the rear surface of the main body.

20. The protective garment of claim 13, wherein the sealed inlet opening for an air line comprises a longitudinally-extending tubular section of fabric having a diameter slightly greater than an air line hose diameter.

* * * * *